United States Patent [19]

Robinson

[11] Patent Number: 4,976,894

[45] Date of Patent: Dec. 11, 1990

[54] CARBON DIOXIDE INJECTION INTERFACE IN CARBONATION APPARATUS

[75] Inventor: Bruce R. Robinson, Stevensville, Md.

[73] Assignee: NSA Acquisition, Inc., Memphis, Tenn.

[21] Appl. No.: 411,567

[22] Filed: Sep. 22, 1989

[51] Int. Cl.[5] ..... B01F 3/04

[52] U.S. Cl. ..... 261/64.1; 261/DIG. 7; 261/124; 215/247; 141/330

[58] Field of Search ..... 285/910; 215/247; 141/329, 330; 261/DIG. 7, 64.1, 124

[56] References Cited

U.S. PATENT DOCUMENTS

| | | | |
|---|---|---|---|
| 2,190,054 | 2/1940 | Cutter et al. | 215/247 |
| 2,436,291 | 2/1948 | Daniel | 215/247 |
| 2,747,905 | 5/1956 | Clade | 285/910 |
| 2,770,477 | 11/1956 | Rankin | 285/910 |
| 2,805,846 | 9/1957 | Dewan | 261/DIG. 7 |
| 3,085,454 | 4/1963 | Federighi | 141/329 |
| 3,463,339 | 8/1969 | McGuckin | 215/247 |
| 3,986,535 | 10/1976 | Meckstroth | 141/329 |
| 4,084,718 | 4/1928 | Wadsworth | 215/247 |
| 4,210,623 | 7/1980 | Breno et al. | 141/330 |
| 4,481,986 | 11/1984 | Meyers | 261/DIG. 7 |

*Primary Examiner*—Tim Miles

*Attorney, Agent, or Firm*—Heiskell, Donelson, Bearman, Adams Williams & Kirsch

[57] ABSTRACT

In a system in which a $CO_2$ injection nozzle penetrates into an inverted sealed vessel from which a beverage will be served, such as a soda bottle, the preferably needle-like nozzle projects vertically through an aperture in a cap and through a normally closed hole in a septum comprising a portion of an elastomeric gasket providing a seal between the cap and the vessel. The nozzle provides a path for communication of liquid in the vessel with a source of $CO_2$. The nozzle is formed out of a mixture of polycarbonate resin and polytetrafluoroethylene to provide for ease of insertion through the hole in the septum and into liquid in the vessel. A low friction washer between the cap and the gasket decreases torque applied to the gasket as the cap is tightened to provide compressive force.

17 Claims, 1 Drawing Sheet

CARBON DIOXIDE INJECTION INTERFACE IN CARBONATION APPARATUS

BACKGROUND OF THE INVENTION

The present invention relates to apparatus for carbonating liquids and more particularly to means for facilitating interface of $CO_2$ injection means into a container from which a beverage will be served.

Home carbonation apparatus is well-known in the art and may take many different forms. A common characteristic of home carbonation systems, as this term is used in the present specification, is that liquid is introduced into a vessel from which it will be served and carbonated in that vessel. Such serving vessels comprise types of containers most commonly known as seltzer bottles and soda bottles. Vessels are distinguished from dispensers in the present description in that a dispenser is normally stationary and kept in the same place and spatial orientation whether in the process of storing or dispensing. Home carbonation implies that the vessel in which liquid being carbonated is of a conveniently handled size corresponding to common nominal sizes in which carbonated beverages for providing multiple servings are usually sold. These sizes range primarily from 28 fluid ounces to one liter (33.4 fluid ounces).

Simpler forms of home carbonation apparatus use the well-known single charge $CO_2$ gas cartridge commonly available in hardware stores having a tube of $CO_2$ closed in a tube with a puncturable metal seal. The apparatus comprises means for holding the cartridge and for breaking the seal with a pointed end of a tube communicating with means to discharge the $CO_2$ into the vessel and then disposing of the cartridge. An example of such a system for carbonating in a soda bottle is disclosed in U.S. Pat. No. 2,805,846 to L. Dewan issued Sept. 10, 1957. Many other single charge cartridge systems have also been provided in the context of a seltzer bottle. Only one vessel full of liquid is carbonated per operation of installation in the system of a carbon dioxide source.

Increasing sophistication in home carbonation systems has led to the use of a more substantial $CO_2$ gas canister with the capacity for carbonating many vessels. For example, a nominal $CO_2$ canister may be capable of carbonating two hundred one liter bottles of water. Such a container is conveniently usable at home and could weigh as little as six pounds. Nominal dimensions are a diameter of seven inches and a height of eighteen inches. In a home apparatus using such a canister, a base is provided for individual connection of a canister thereto and for readily releasable engagement of a vessel therewith. An example of such a system in the prior art is disclosed in U.S. Pat. No. 4,481,986 issued Nov. 13, 1984.

In such a system, a $CO_2$ canister is inverted and supported to the base. Valve means communicate $CO_2$ from the canister and an inlet to a fluid path in the base. $CO_2$ outlet means are provided for injecting $CO_2$ into a vessel. Further valve means control flow from inlet to the outlet. The outlet means include a vertically disposed, hollow, needle-like nozzle opened at an upper end having a gas path along a vertical axis and allowing gas to escape at an upper end thereof into the vessel. The system uses a vessel sized for cooperation therewith. The vessel is closed with a cap. The cap remains on the vessel during carbonation and storage. It is removed for serving the beverage.

The cap contains an elastomeric insert which is compressed between the cap and the vessel and which normally seals the vessel. The insert defines a septum having a normally closed hole therein. The hole can be forced open by insertion of the needle-like nozzle. After the nozzle is withdrawn from the septum, the hole closes completely, and the cap seals the vessel. An aperture is provided in the cap in registration with the normally closed hole in the septum to permit penetration of the nozzle. The aperture is substantially concentric with the nozzle during insertion.

In use, liquid is placed in the vessel which is sealed with the cap. The vessel is then inverted and brought into engagement with the system. More specifically, the cap is pressed onto the vertically extending nozzle and the vessel is lowered to be supported to the base. The nozzle enters and penetrates through a septum in the cap and extends into the liquid. The further valve means are opened and the liquid is carbonated. Suitable pressure regulating means provide for proper pressurization. The further valve means are closed, and the vessel is removed from engagement with the system.

The same septum that opens to receive penetration of the needle-like nozzle, must close to seal the cap once the nozzle is removed. The tighter to hole, the better the seal when the vessel is storing carbonated apparatus. However, if penetration is made too difficult, it may not be achieved, or undue stress may be placed on the penetrating member. Also, in closing the a threaded cap onto a vessel, the cap is rotated. During initial stages of closure, the cap may simply provide compressive force against the elastomeric insert. As it is further tightened, torque may be applied to the insert, and the material around the closable hole is twisted. This can further impede ease in insertion and removal.

In such a system, it is desirable facilitate interface of $CO_2$ injection means with the vessel in the carbonation mode. Maximizing the ease with which the needle-like nozzle can penetrate the septum allows optimizing tightness of the seal versus convenience of entry and withdrawal. The present invention deals with an interactive system and improved components therefor for facilitating insertion into a removal of a carbonation nozzle in and out of a septum in a carbonation vessel cap.

SUMMARY OF THE INVENTION

It is therefore an object of the present invention to provide a means for optimizing tightness of a sealing gasket versus ease of insertion and withdrawal of a carbonation nozzle in a system in which a $CO_2$ injection nozzle penetrates into an inverted sealed vessel from which a beverage will be served, such as a soda bottle through a normally closed hole in a septum comprising a portion of an elastomeric gasket providing a seal between the cap and the vessel.

It is a further object of the present invention to provide an improved $CO_2$ injection nozzle for inclusion an apparatus of the type described.

It is a more particular object of the present invention to provide an improved carbonation system for receiving an inverted vessel for carbonation.

Briefly stated in accordance with the present invention there is provided in a system in which a $CO_2$ injection nozzle penetrates into liquid to be carbonated in an inverted sealed vessel from which a beverage will be served, such as a soda bottle, improved means for facilitating insertion and removal of the nozzle while maintaining a tight seal. The preferably needle-like nozzle projects vertically through an aperture in a cap and through a normally closed hole in a septum comprising a portion of an elastomeric gasket providing a seal between the cap and the vessel. The nozzle provides a path for communication of liquid in the vessel with a source of $CO_2$. The nozzle is formed out of a mixture of from about five parts to nine parts polycarbonate resin to one part polytetrafluoroethylene by weight to provide for ease of insertion through the hole in the septum and into liquid in the vessel. A low friction washer between the cap and the gasket decreases torque applied to the gasket as the cap is tightened to provide compressive force.

BRIEF DESCRIPTION OF THE DRAWINGS

The means by which the foregoing objects and features of invention are achieved are pointed out with particularity in the claims forming the concluding portion of the specification. The invention, both as to its organization and manner of operation, may be further understood by reference to the following description taken in connection with the following drawings.

Of the drawings.

DESCRIPTION OF THE PREFERRED EMBODIMENTS

Figure 1:
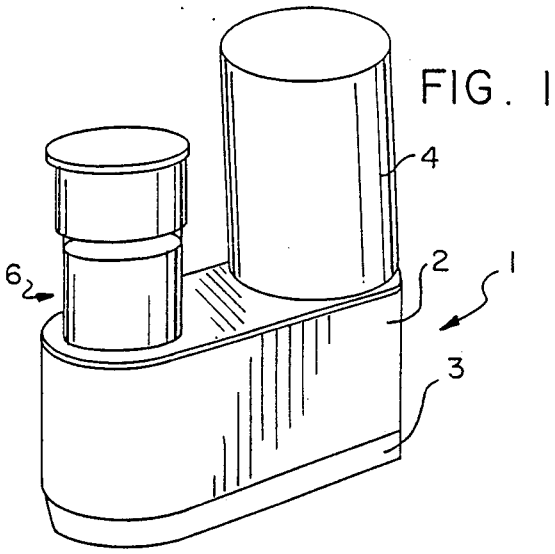
FIG. 1 is an axonometric view of a home carbonation apparatus incorporating the present invention.
Figure 2:
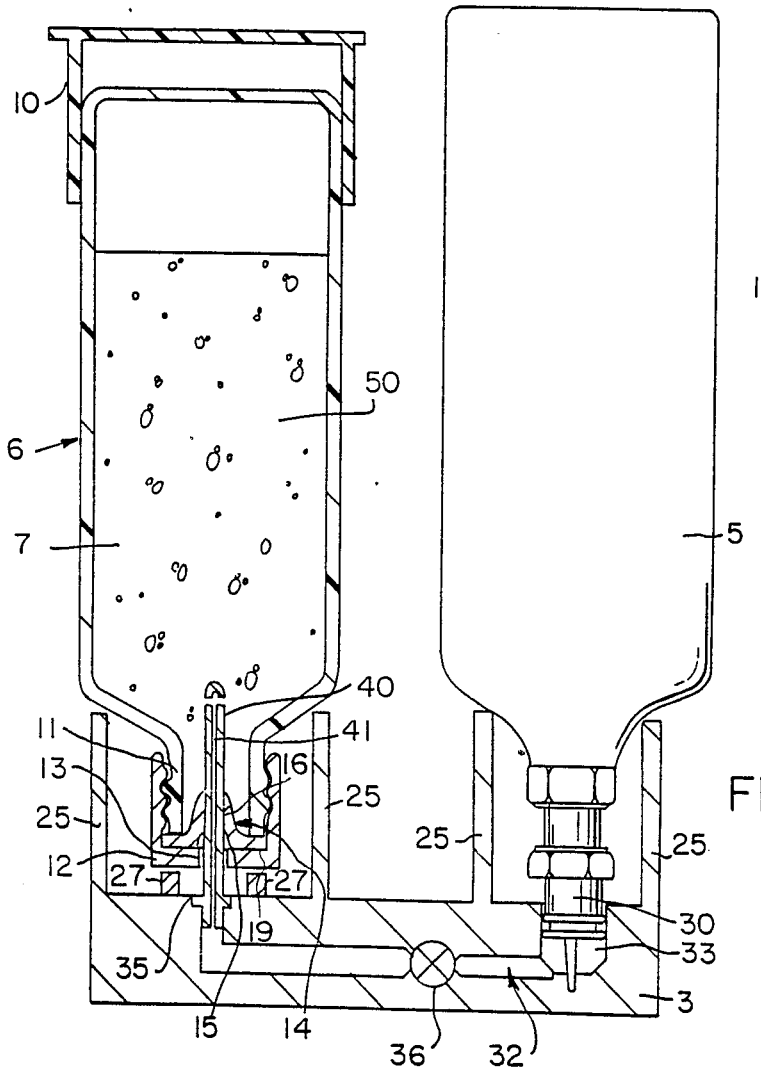
FIG. 2 is an elevation, partially in cross section and partially in mechanical schematic form, of the apparatus of FIG. 2 with a cover removed.

FIG. 1 is an axonometric view of a carbonation apparatus 1 suitable for home use in that one container of liquid, preferably in a popular size for home consumption, is carbonated, and that same container is used for both storage in a refrigerator and for serving. FIG. 2 is an elevation of the apparatus of FIG. 1 illustrated without a cover and illustrated partially in cross-sectional and partially in mechanical schematic form. In each FIGURE, the same reference numerals are used to illustrate the same components.

In the carbonation apparatus 1, a housing 2 is supported to a base 3. The housing 2 encloses the means further described below that provide interfaces to a $CO_2$ source and to the liquid to be carbonated. A modular cover cylinder 4 fits into the housing 2 to define an enclosure for a cylinder 5 (FIG. 2) providing $CO_2$ gas. The cylinder 5 contains $CO_2$ liquid, and is configured to provide $CO_2$ gas at its output. It would be highly undesirable to provide $CO_2$ liquid into a home carbonation system due to the very high pressures which would be necessary to contain the liquid. A bottle 6, preferably plastic, is the vessel containing the liquid 7 to be carbonated, and is illustrated in an inverted position. The bottle 6 is press fit, and may also be cemented, into a cylindrical base 10 which supports the bottle 6 when it is disposed in a right-side-up vertical disposition. The bottle 6 opens at a threaded neck portion 11. The bottle 7 is closed by a removable cap 12 having an interior thread. The cap 12 has a central aperture 13 to permit penetration of nozzle means 40 described below.

Elastomeric gasket means 14 are inserted in the cap 12 to provide a seal between the cap 12 and an upper surface of the neck 11. A central slit, or normally closed hole, 15 in a central reinforced portion 16 of the gasket 14 permits entry of the nozzle means 40 and seals itself when the nozzle means 40 is removed. The cap 12 is thus self-sealing. The portion of the gasket 14 held in place by the cap 12 to form the closure of the bottle 6 defines a septum 17. A low friction washer 19 is provided between the gasket 14 and the cap 12. Functioning of the washer 19 is described further with respect to FIG. 4 below.

The central slit 15 forms a normally closed hole. The slit, being of elastomeric material, is deformable in response to penetration by the nozzle means 40. The smaller the hole is compared to the diameter of the nozzle means 40, the tighter the seal will be. This will, however, increase difficulty of insertion and removal of the nozzle means 40. It is desirable to provide for ease of relative movement of the nozzle 40 to the gasket 14. Well-known low friction materials such as polytetrafluoroethylene, PTFE, widely available under the trademark Teflon, do not have sufficient strength to reliably repeatedly withstand the high forces applied thereto.

This is particularly significant where the nozzle 40 is needle shaped and easily subjected to bending or breaking forces. Other materials, e.g. stainless steel may be strong but have higher coefficients of friction. A desirable material that is available other than steel is strong plastic such as a strong polycarbonate resin such as the type available from General Electric Company under the trademark Lexan. This material will be referred to for the purposes of the present description as structural resin.

In accordance with the present invention, it has been found that it is desirable to form the nozzle 40 from a combination of structural resin and PTFE in a desired range of proportions. In one exemplification, the nozzle 40 is made by combining TEFLOP PTFE with LEXAN polycarbonate resin. It has been found that it is preferable to use 10–16% PTFE by weight. An optimized proportion has been found to be 12%. In other words, a mixture is formed of from about five parts to nine parts structural resin to one part PTFE by weight.

Vertical arms 25 extending from the base 3 support the bottle 6 when it is brought into engagement with the carbonation apparatus 1. Stop means 27 mounted to the base 3 provide for limiting of movement of the cap 12 with respect to the base 3. In use, a bottle 6 is placed in the upright position with the cap 12 removed therefrom. Liquid 7 is placed in the bottle 6 which is then closed by a cap 12. The bottle 6 is inverted and inserted into the carbonation apparatus 1. Downward vertical motion is limited by movement of the cap 12 against the stop means 27. The vertical arms engage the bottle 6. Where the bottle 6 is plastic rather than glass, dimensioning of the vertical arms 25 is not critical since the surface of the bottle 6 will deform to permit vertical movement to seat the cap 12 properly on the stop means 27.

The $CO_2$ canister 5 is supported to the base 3 by further vertical support arms 25. Valve and outlet means 30 interface the $CO_2$ supply to the base 3. The base 3 comprises a gas path 32 having an input section 33 which receives the valve and outlet means 30. An outlet section 35 is provided for coupling $CO_2$ to the bottle 6 in a manner further described below. A valve 36 is provided to selectively open or close the gas path 32.

Figure 3:
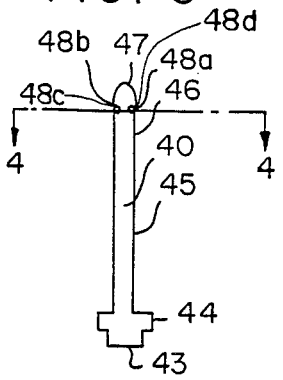
FIG. 3 is an elevation of the $CO_2$ inlet nozzle incorporated in FIG. 2.

In operation, gas is coupled from the gas path 32 to be delivered from the carbonation apparatus 1 by a nozzle 40, whose disposition is illustrated in FIG. 2, and details of which are illustrated in FIGS. 3. FIG. 3 is an elevation of the nozzle 40. The nozzle 40 comprises an elongated cylinder with an axial internal bore 41. The nozzle 40 is open at a lower end 43 for communication of the internal bore 41 with the output section 35 of the gas path 32. A radially enlarged exterior portion 44 is provided for swaging the nozzle 40 into a recess in the base 3. The nozzle 40 includes a first axial portion adjacent the lower end 43 which is designed to be in registration with interface means. More particularly, the portion 45 will project through the cap 12 and will extend through the slit 15 and be surrounded by the sealing gasket 14. A second axial portion 46 is farther from the lower end 43 and serves to extend the nozzle 40 into the bottle 6 beyond the narrowest portions of the neck portion 11.

The nozzle 40 may be open at the upper axial end thereof, but preferable comprises an axial end 47 closing the gas path defined by the bore 41. Outlet means 48 are provided communicating the $CO_2$ path from the interior of the nozzle 40 to the exterior thereof and to impart to gas exiting therefrom a horizontal component in its path for increasing carbonation is achieved since the path length of travel of the $CO_2$ is increased compared to embodiments in which the $CO_2$ exits vertically. The travel path is indicated schematically by the illustration in FIG. 1 of bubbles 50 in the liquid 7. Outlets **48*a* and 48*b* are seen on the side of the nozzle 40 seen in FIG. 3, and additional outlets 48*c* and 48*d* are illustrated by hidden lines directly coinciding with the positions of outlets 48*b* and 48*a* respectively. The preferred outlet arrangement for the nozzle 40** is described in copending patent application Ser. No. 07/317,628, the disclosure of which is incorporated by reference herein.

Figure 4:
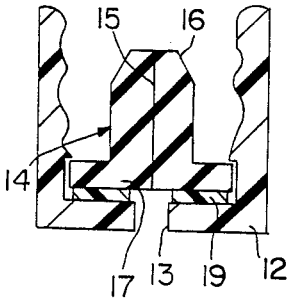
FIG. 4 is a partial detailed view of FIG. 2 illustrating the cap assembly in cross section with the $CO_2$ inlet nozzle removed therefrom.

FIG. 4 is a partial detail of FIG. 2 illustrating the cap 12 and components housed therein in cross-sectional form. As more easily seen in FIG. 4, the washer 19 is interposed between the gasket 14 and the cap 12. The washer 19 may be thin so as not to unduly increase the necessary size of the cap 12. Its function is to act as a friction bearing. In its preferred form, the washer 19 may be a 3 mil thick PTFE washer. In operation, when the bottle 6 is sealed, the cap 12 must be twisted to move axially and provide compressive force on the gasket 14. Once the gasket 14 engages the bottle 6, further twisting of the cap 12 tends to twist the gasket 14. This would tend to make smaller the normally closed hole 15. This makes insertion of the nozzle 40 more difficult, and this difficulty may be difficult to adjust for by other means since it will be non-uniform depending on how tightly an individual user twists the cap 12. The washer 19 permits relative rotational movement of the cap with respect to the gasket 14 even after the gasket 14 has engaged the bottle 6 and stopped rotating in relation thereto. Consequently, twisting of the gasket 14 and deformation tending to cause constriction of the normally closed hole 15 is minimized.

In addition, use of the washer 19 provides for more reliable sealing of the cap 12 to the bottle 6. Once the gasket 14 engages the bottle 6, torque is applied thereto upon further rotation of the cap 12. The gasket tends to be deformed, weaking its ability to provide a reliable seal. Because of the elastomeric properties of the gasket 14 and the torsion applied thereto, the gasket 14 tends to return to its original shape. In effect, the gasket 14 tends to unscrew the cap 12. Greater tightening of the cap 12 can actually yield less satisfactory sealing. Improper and inadequate sealing results. With the washer 19 acting as low-friction bearing means, relative motion of the cap 12 relative to the gasket 14 is permitted. Consequently, after the gasket 14 engages the bottle 6, further rotation of the cap 12 produces substantially compressive force, strengthening the seal provided by the gasket 14. Torsion on the gasket 14 is minimized.

In this manner, tightness of a sealing gasket versus ease of insertion and withdrawal of a carbonation nozzle is optimized. The above teachings have been written with a view toward enabling those skilled in the art to depart from the specifics of the preferred embodiments to provide apparatus constructed in accordance with the present invention.

What is claimed as new and desired to be secured by Letters Patent of the United States is:

1. In a carbonation apparatus of the type comprising means for injecting $CO_2$ into liquid in an interior of an inverted serving vessel, said means including a nozzle for penetration through a normally closed hole in a septum to project into liquid to be carbonated, said septum being retained between a cab and the vessel, said cap being rotatable to close the vessel, said nozzle being constructed to communicate with a source of $CO_2$, the improvement wherein said nozzle is formed of from about five parts to about nine parts structural resin to one part PTFE by weight.

2. The improvement according to claim 1 wherein said nozzle comprises ten percent PTFE by weight.

3. The improvement according to claim 2 wherein said structural resin comprises polycarbonate resin.

4. The improvement according to claim 3 wherein said nozzle is substantially needle shaped.

5. The improvement according to claim 1 wherein said nozzle is substantially needle shaped.

6. The improvement according to claim 5 further comprising low friction bearing means interposed between said septum and said cap, whereby deformation of said septum due to torsion is minimized when said septum is compressed between said cap and said bottle.

7. The apparatus according to claim 6 wherein said low friction bearing means comprises a PTFE washer.

8. The apparatus of claim 1 wherein said nozzle includes a vertical bore in communication with said source of $CO_2$, said bore including at least one generally horizontal passage through a side portion of said nozzle, wherein said $CO_2$ exits said bore through said passage into vessel.

9. A nozzle for inclusion in an apparatus for carbonating an inverted container receiving said nozzle through elastomeric means in a self-sealing cap and wherein $CO_2$ enters the liquid through the nozzle, the improvement wherein said nozzle is formed of from about five parts to about nine parts structural resin to one part PTFE by weight.

10. The improvement according to claim 9 wherein said nozzle comprises ten percent PTFE by weight.

11. The improvement according to claim 10 wherein said structural resin comprises polycarbonate resin.

12. The improvement according to claim 11 wherein said nozzle is substantially needle shaped.

13. The improvement according to claim 9 wherein said nozzle is substantially needle shaped.

14. In a carbonation apparatus of the type comprising means for injecting $CO_2$ into liquid in an interior of an inverted serving vessel, said means including a nozzle for penetration through a normally closed hole in a septum to project into liquid to be carbonated, said septum being retained between a cap and the vessel, said cap being rotatable to close the vessel, said nozzle being constructed to communicate with a source of $CO_2$, and wherein said nozzle is formed of from about five parts to about nine parts structural resin to one part PTFE by weight, the improvement further comprising low friction bearing means interposed between said septum and said cap, whereby deformation of said septum due to torsion is minimized when said septum is compressed between said cap and said bottle.

15. The apparatus according to claim 14 wherein said low friction bearing means comprises a PTFE washer.

16. In a carbonation apparatus of the type comprising means for injecting $CO_2$ into liquid in an interior of an inverted serving vessel, said means including a nozzle for penetration through a normally closed hole in a septum to project into liquid to be carbonated, said septum being retained between a cap and the vessel, said cap being rotatable to close the vessel, said nozzle being constructed to communicate with a source of $CO_2$, the improvement further comprising low friction bearing means interposed between said septum and said cap and freely rotatable relative to said septum, whereby deformation of said septum due to torsion is minimized when said septum is compressed between said cap and said bottle.

17. The apparatus according to claim 16 wherein said low friction bearing means comprises a PTFE washer.

* * * * *

UNITED STATES PATENT AND TRADEMARK OFFICE

CERTIFICATE OF CORRECTION

PATENT NO. : 4,976,894

DATED : December 11, 1990

INVENTOR(S) : Bruce R. Robinson

It is certified that error appears in the above-identified patent and that said Letters Patent is hereby corrected as shown below:

Col. 4, line 41, "TEFLOP" should be --Teflon--; and

Signed and Sealed this

Eleventh Day of August, 1992

*Attest:*

DOUGLAS B. COMER

*Attesting Officer*

*Acting Commissioner of Patents and Trademarks*